US005267371A

United States Patent [19]

Soler et al.

[11] Patent Number: 5,267,371

[45] Date of Patent: Dec. 7, 1993

[54] CYCLONIC BACK-PACK VACUUM CLEANER

[75] Inventors: Norman V. Soler, Port Colborne; Tat-Chi A. Tsui, St. Catharines; Donald LaBute, Welland, all of Canada

[73] Assignee: Iona Appliances Inc., Welland, Canada

[21] Appl. No.: 19,485

[22] Filed: Feb. 19, 1993

Related U.S. Application Data

[63] Continuation-in-part of Ser. No. 838,183, Feb. 20, 1992, abandoned.

[30] Foreign Application Priority Data

Feb. 19, 1992 [CA] Canada ..... 2061469

[51] Int. Cl.[5] ..... A47L 5/36

[52] U.S. Cl. ..... 15/327.5; 15/352; 15/353; 55/356; 55/429

[58] Field of Search ..... 15/327.5, 413, 353, 15/352; 55/356, 429

[56] References Cited

U.S. PATENT DOCUMENTS

| | | | |
|---|---|---|---|
| 1,759,947 | 5/1930 | Lee . | |
| 1,953,944 | 4/1934 | Becker . | |
| 2,071,975 | 2/1937 | Holm-Hansen et al. . | |
| 2,171,248 | 8/1939 | Berkel . | |
| 2,316,836 | 4/1943 | Breuer | 55/356 X |
| 2,504,846 | 4/1950 | Kirby . | |
| 2,542,634 | 2/1951 | Davis et al. . | |
| 2,560,728 | 7/1951 | Lee | 99/250 |
| 2,684,125 | 7/1954 | Brace . | |
| 2,768,707 | 10/1956 | Campbell . | |
| 2,824,335 | 2/1958 | Moffat . | |
| 2,943,698 | 7/1960 | Bishop | 55/429 X |
| 3,165,774 | 1/1965 | Barba | 15/327.5 X |
| 3,286,446 | 11/1966 | Happe et al. | 15/327.5 X |
| 3,308,609 | 3/1967 | McCulloch et al. . | |
| 3,320,727 | 5/1967 | Farley et al. . | |
| 3,331,090 | 7/1967 | Reiber et al. | 15/327.5 X |
| 3,425,192 | 2/1969 | Davis . | |
| 4,373,228 | 2/1983 | Dyson . | |
| 4,551,041 | 11/1985 | Coon et al. | 406/85 |
| 4,571,772 | 2/1986 | Dyson . | |
| 4,593,429 | 10/1986 | Dyson . | |
| 4,645,542 | 2/1987 | Scharton et al. | 134/1 |
| 4,806,277 | 2/1989 | Sakurai et al. | 252/626 |
| 4,966,177 | 10/1990 | John, Jr. et al. | 134/61 |
| 4,974,617 | 12/1990 | Simon | 134/22.12 |
| 5,078,761 | 1/1992 | Dyson | 55/429 X |
| 5,080,697 | 1/1992 | Finke . | |

FOREIGN PATENT DOCUMENTS

| | | |
|---|---|---|
| 1159610 | 1/1984 | Canada . |
| 1162362 | 2/1984 | Canada . |
| 1182613 | 2/1985 | Canada . |
| 1238869 | 7/1988 | Canada . |
| 1241158 | 8/1988 | Canada . |
| 44-70008 | 8/1969 | Japan . |

OTHER PUBLICATIONS

Canadian Industrial Design Registration No. 54, 488—May 21, 1985, Prototypes Ltd.

Canadian Industrial Design Registration No. 60, 796—May 10, 1988, Iona Appliances Inc.

Brochure by Rotobic Pty. Ltd. for Pocket Vac and Rocket Vac Vacuum Cleaners (undated).

Brochure by Miracle Marketing Corp. for the Optimus Vacuum Cleaner (undated).

Operating instructions for the Megavac Vacuum Cleaner (undated).

One page brochure for the Megavac Vacuum Cleaner (undated).

Operating instructions for the Quarter-Vac Vacuum Cleaner (undated).

Brochure for the Linevacer Vacuum Cleaner (undated).

Brochure for the Pro-Team Quatervac Vacuum Cleaner (undated).

Brochure entitled "The Pro-Team Option" (undated).

*Primary Examiner*—Chris K. Moore

*Attorney, Agent, or Firm*—Bereskin & Parr

[57] ABSTRACT

A back-pack vacuum cleaner comprises a back-pack harness, an upper casing attached to the harness and a lower casing rotatably mounted on the upper casing. A cyclonic cleaning assembly is mounted within the upper casing such that at least part of the assembly extends into the lower casing. The motor is positioned within the upper casing above the cyclonic cleaning assembly.

20 Claims, 7 Drawing Sheets

CYCLONIC BACK-PACK VACUUM CLEANER

This application is a continuation-in-part of U.S. application Ser. No. 07/838,183 filed on Feb. 20, 1992, and now abandoned.

FIELD OF THE INVENTION

The present invention relates to vacuum cleaners which have a harness so that they may be worn as a backpack by the operator. In particular, it relates to vacuum cleaners of the cyclonic type.

BACKGROUND OF THE INVENTION

There are various types of vacuum cleaners including upright vacuum cleaners and canister vacuum cleaners. An upright vacuum cleaner comprises two main sections namely a ground engaging portion mounted on wheels and a dirt collection portion which is pivotably mounted above the ground engaging portion. The ground engaging portion includes a cleaning head and a motor. The dirt collection portion includes a filtration means for separating entrained dirt from the intake air and means for storing the separated dirt.

Canister vacuum cleaners are substantially cylindrical in shape and comprise a rigid outer container and a hose assembly. The rigid outer container is mounted on wheels for ease of movement. The outer container is substantially cylindrical in shape and has a side which is substantially circular in cross-section. The wheels may be mounted either on the side of the container so that the longitudinal axis of the canister extends horizontally or on one end of the canister so that the longitudinal axis of the canister extends vertically. If the unit is horizontally disposed, the hose assemby is mounted on one end of the outer container. A dirt filter and collector, such as a bag, is positioned adjacent that end of the container and a motor is positioned behind the dirt filter and collector. In operation, the dirty air passes through the hose into the dirt filter and collector and the filtered air passes by the motor before exiting the vacuum cleaner. Alternately, when the vacuum cleaner is vertically disposed, the motor is mounted on top of the outer container and the motor and/or the filter means may extend into the outer container. The outer container has an air entry port to which the hose assembly is mounted. In operation, the dirty air passes through the hose into the outer container and is then filtered prior to exiting the machine.

In canister vacuum cleaners a cleaning head is attached to the end of the hose assembly distal to the entry port on the outer container. This design results in a cleaning head which is small and manouverable. However, canister vacuum cleaners have several disadvantages. If the unit is vertically disposed, the dirt will collect in the bottom of the outer container and the air entry port must be located near the upper portion of the outer container. Otherwise, the entry port would become clogged with dirt and this would decrease the efficiency of the vacuum cleaner. The motor and filter mechanism are mounted near the upper portion of the canister vacuum cleaner and accordingly the centre of gravity of the machine is relatively high. In operation, the operator typically moves these machines by pulling on the hose, which is attached to the outer container. The raised centre of gravity of the machine results in the machine being top heavy and prone to tipping. Further, since a friction fit may be used to removably mount the hose assembly in the entry port, it is occasionally necessary for the operator to cease operation and re-insert the hose to maintain a hermetic seal which is loosened by pulling on the hose assembly.

Accordingly, canister machines and in particular vertically disposed canister vacuum cleaners, can most conveniently be used within a circle having a radius somewhat smaller than the length of the hose assembly. Outside such a circle, the machine must be carefully moved from position to position to avoid tipping the machine. These machines are typically awkward to move and care is also required to avoid hitting and damaging walls and furniture.

Upright vacuum cleaners have the advantage that the motor is mounted in the ground engaging portion. Accordingly, the centre of the gravity of the machine is adjacent to the ground and the machines are not prone to tipping. In the past, these machines have typically comprised a filter mechanism which may be a cloth or paper bag. More recently, dual cyclonic upright vacuum cleaners have been developed. These upright machines utilize cyclonic action or centrifugal force to separate the entrained dirt from the intake air. As is shown in Canadian Patent Nos. 1,182,613; 1,238,869 and 1,241,158, and corresponding U.S. Pat. Nos.: 4,593,492; 4,826,515; 4,853,011; 5,160,356; 4,643,748 and 4,571,772, which are incorporated herein by reference, a cyclonic vacuum cleaner may utilize first and second cyclones which are connected in series. The first or outer cyclone is designed to remove the larger and heavier dirt particles which are entrained in the intake air and the second or inner cyclone is used to remove the finer and lighter particles which are entrained in the exhaust air from the first cyclone.

One of the disadvantages with upright vacuum cleaners is that during operation, the entire machine is continually being moved by the operator. This results in the operator becoming tired. Further, the ground engaging portion is relatively large and must be moved with care around furniture and other obstacles. Due to its size, the ground engaging portion may be too large to clean confined spaces. Thus, these machines are often designed to accept a hose assembly so that the upright vacuum cleaner may be used in a canister mode. This results in additional design complexities. Further, the operator must also carry around the hose assembly. These problems are accentuated in a commercial environment where an operator may use a machine for several hours at one time to clean large areas.

Another type of vacuum cleaner is the back-pack vacuum cleaner. Examples of such machines are the QUARTER-VAC, the MEGAVAC, the POCKET VAC, the OPTIMUS 1 and the LINEVACER. These machines have a upper portion which contains a filter bag or other filter medium. The motor is located adjacent the bottom of the vacuum cleaner below the filter means. The hose assembly is connected to the top of the machine so that the intake air passes from the top of the machine through the filter means, past the motor and is then exhausted from the machine.

Back-pack vacuum cleaners have been used in the commercial environment, and accordingly they must be worn by the operator for several hours at a time and, possibly, for an entire shift. Due to the nature of existing designs, these machines feel heavy and uncomfortable and accordingly they are not desirable for extended hours of use.

SUMMARY OF THE INVENTION

It has been found that these disadvantages can be overcome by using a cyclonic vacuum cleaner which comprises a back-pack harness, an upper casing attached to the harness, a lower casing releasably mounted on the upper casing, at least one cyclone mounted with at least the lower part thereof positioned within the lower casing, an air entry means providing an air flow path from outside the vacuum cleaner to the at least one cyclone, an air exit means providing an air flow path from the at least one cyclone to outside the vacuum cleaner and fan means driven by a motor positioned within the upper casing above the at least one cyclone for generating a flow of air which passes through the air entry means, through the at least one cyclone, and through the air exit means.

Preferably, the vacuum cleaner comprises a first cyclone and a second cyclone in series. The incoming air enters the first cyclone and passes from the exit of the first cyclone to the entrance of the second cyclone. The air exits from the second cyclone and preferably is used to cool the motor which is located above the exit from the second cyclone. The air entry means may comprise a port for supplying dirt laden air tangentially to the first cyclone to produce cyclonic rotation of the dirt laden air within the first cyclone. The air entry port may be located near the top of the first cyclone.

The lower casing may comprise the outer wall of the first cyclone and the air entry port may be positioned at the upper portion thereof. The lower casing may be substantially circular in cross-section such that the lower casing may be rotated relative to the upper casing thus permitting the air entry port to be positioned either on the right hand side or the left hand side of the vacuum cleaner to permit ease of use by a right handed operator or a left handed operator.

The air exit means may comprise one port on the upper part of the casing. The exit port may be positioned and configured to direct air flow away from the operator. Further, the exit port may be adapted to receive a hose so that the vacuum cleaner may also be used as a blower. Alternately, or in addition, the exit port may be adapted to receive a filter such that, after passing through said filter, over 99% of 0.3 micrometer size particles have been removed from the incoming dirt laden air.

In contrast to prior vacuum cleaners, this design provides a vacuum cleaner which is ergonomic. The vacuum cleaner is easy to operate and light weight so that it may be worn for an extended period of time by the operator. Further, the vacuum cleaner has an improved filtering mechanism while maintaining a light weight design.

The substance and advantages of the present invention will be more fully and completely described in accordance with following description, and the accompanying drawings, of a preferred embodiment of the invention.

BRIEF DESCRIPTION OF THE INVENTION

DETAILED DESCRIPTION OF PREFERRED EMBODIMENT

Figure 1:
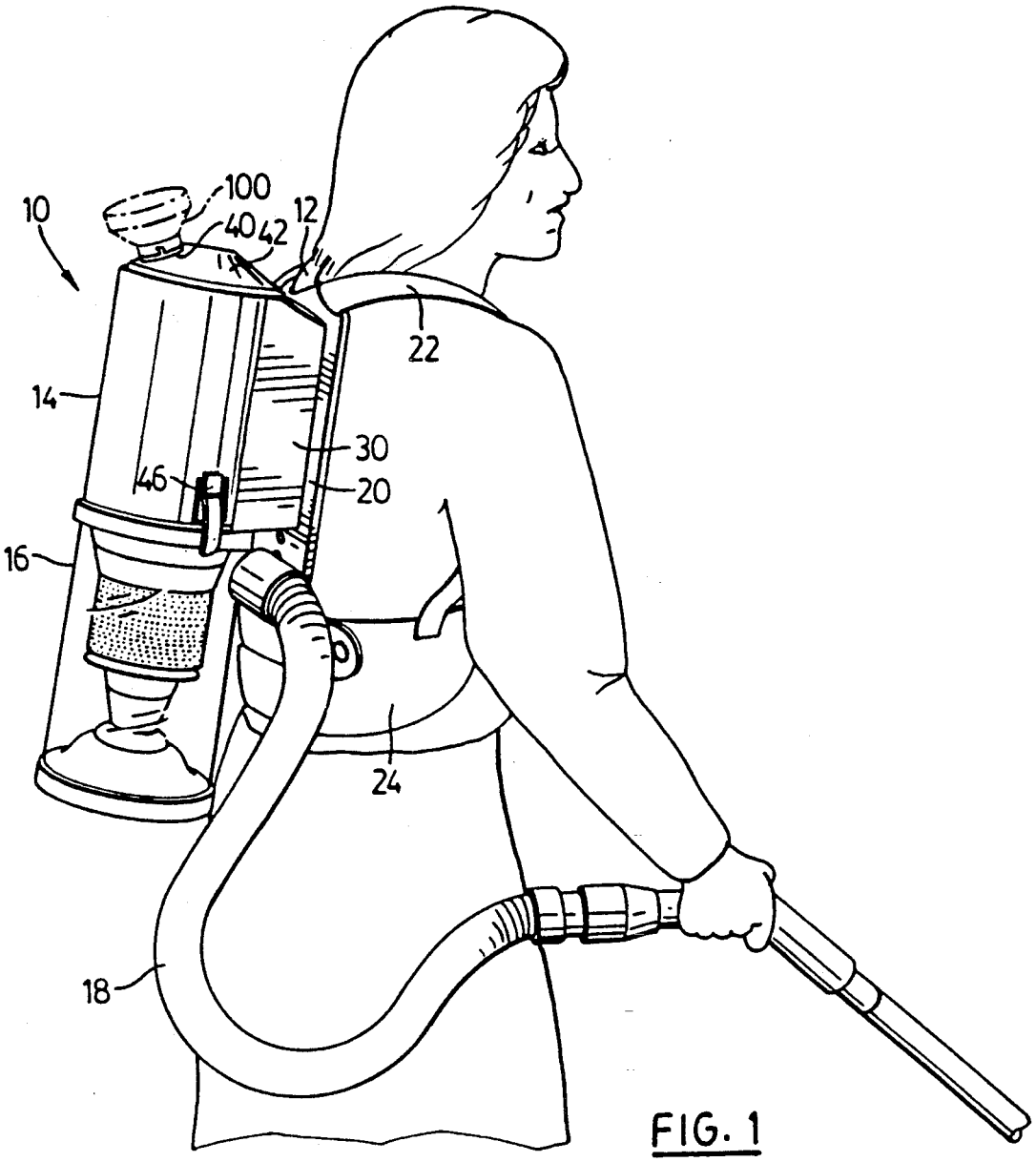
FIG. 1 is a perspective view of a vacuum cleaner according to the invention, when worn by an operator.

As shown in FIG. 1, vacuum cleaner 10 comprises a harness 12, an upper casing 14 and a lower casing 16. The vacuum cleaner is adapted to receive a hose assembly 18. Hose assembly 18 may be of any desired length and, preferably, is designed to receive a variety of interchangeable cleaning heads as may be required.

The back-pack harness may be of any design known in the art. Harness 12 has a back plate 20, two shoulder straps 22 and a waist strap 24. Male and female buckle members 26 and 28 are fixed at the two ends of waist strap 24. Back plate 20 extends from a point near the top of upper casing 14 to a position adjacent the central portion of lower casing 16. The back plate is dimensioned and configured so as to be comfortably mounted on the back of the operator. Shoulder straps 22 are individually adjusted by means known in the art to mount the vacuum cleaner at the proper height for each operator. Similarly, waist strap 24 is adjustable so as to fit around the waist of any operator.

In use, the operator may easily put on the vacuum cleaner and adjust it to fit their body. The operator places his arms through shoulder straps 22 and secures waist strap 24 by inserting male buckle member 26 into female buckle member 28. The shoulder straps and waist straps may then be adjusted to fit the operator.

Figure 2:
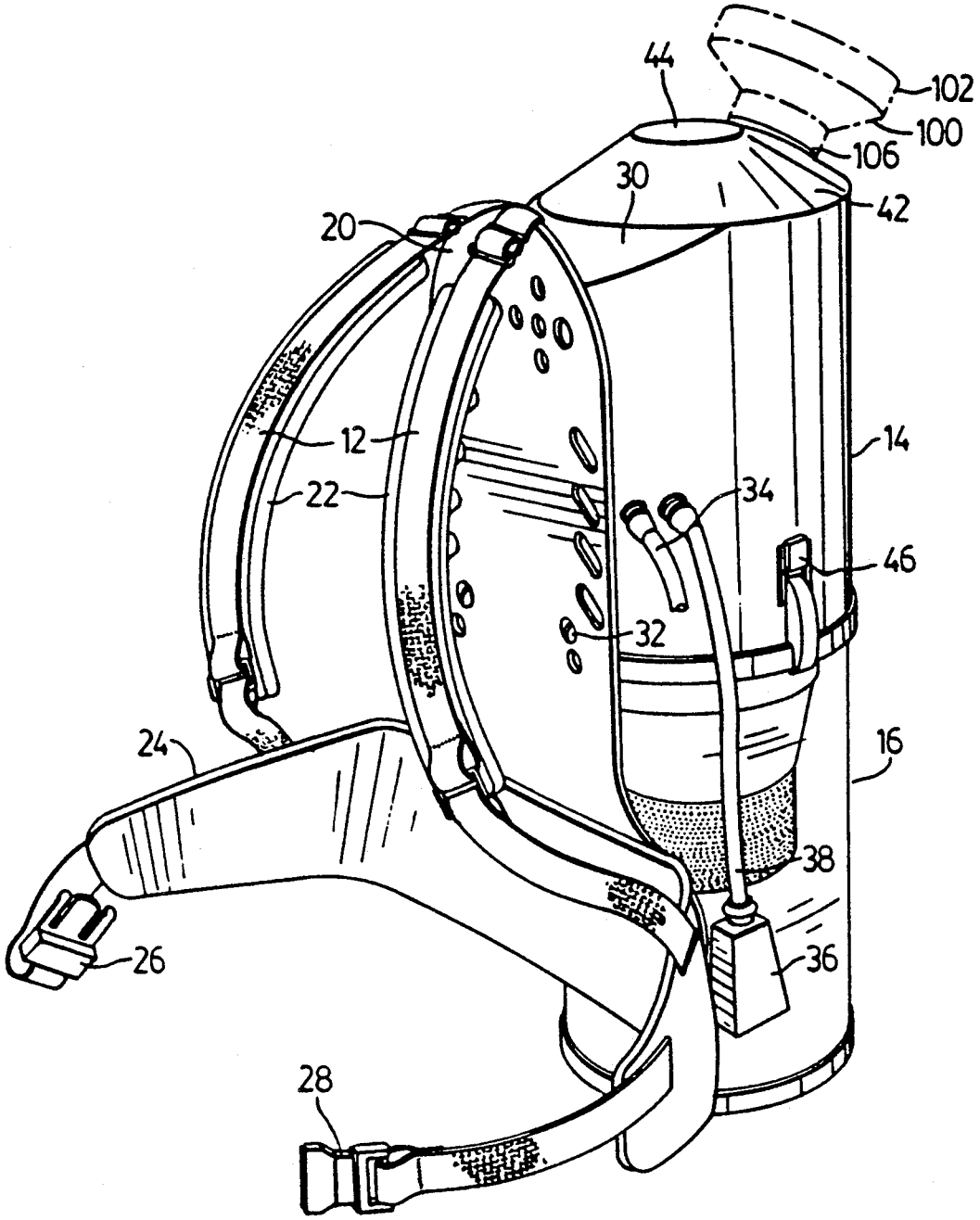
FIG. 2 is a perspective view of the front of the vacuum cleaner of FIG. 1.

Upper casing 14 has a side wall which is substantially cylindrical. The upper casing may be attached to the harness by numerous means. As shown in the Figures, two protrusions 30 extend outwardly from a position near the front of cylindrical housing 14. Back plate 20 may be secured to these protrusions by any means known in the art. As shown in FIG. 2, back plate 20 is secured to protrusions 30 by means of a plurality of screws 32.

The electric cord 34 may be attached to upper casing 14 at any desired point. It has been found advantageous to attach electric cord 34 to one of the protrusions 30. This results in the electrical cord being positioned at a point where it does not interfere with the movement of the hose assembly but where it may be easily grasped by the operator. On/off switch 36 is attached to upper housing 14 by means of control cord 38. By using a control cord, the vacuum cleaner may easily be turned on and off by the operator while wearing the vacuum cleaner. Similarly, as with the electric cord, the control cord may be attached to the vacuum cleaner at any desired location. Once again, it has been found advantageous to locate control cord 38 on one of protrusions 30. If desired, an electrical outlet (not shown) may also be provided on protrusion 30. This would be advantageous if a vacuuming head having an electrically driven motor were to be attached to the vacuum cleaner.

Air exit port 40 is located near the top of upper casing 14. As shown in FIG. 1, air exit port 40 is positioned and configured to direct air flow away from the operator. The upper portion of upper casing 14 comprises a bevelled surface 42 and a top 44. While air exit port 40 is positioned on bevelled surface 42 in the Figures, by suitably adapting the configuration of the air exit port, the air exit port may be positioned at an alternate location on bevelled surface 42 or on top surface 44.

Preferably, air exit port 40 is adapted to receive a hose. By this modification, the vacuum cleaner may be transformed into a blower. This expands the potential use of the vacuum cleaner.

Figure 3:
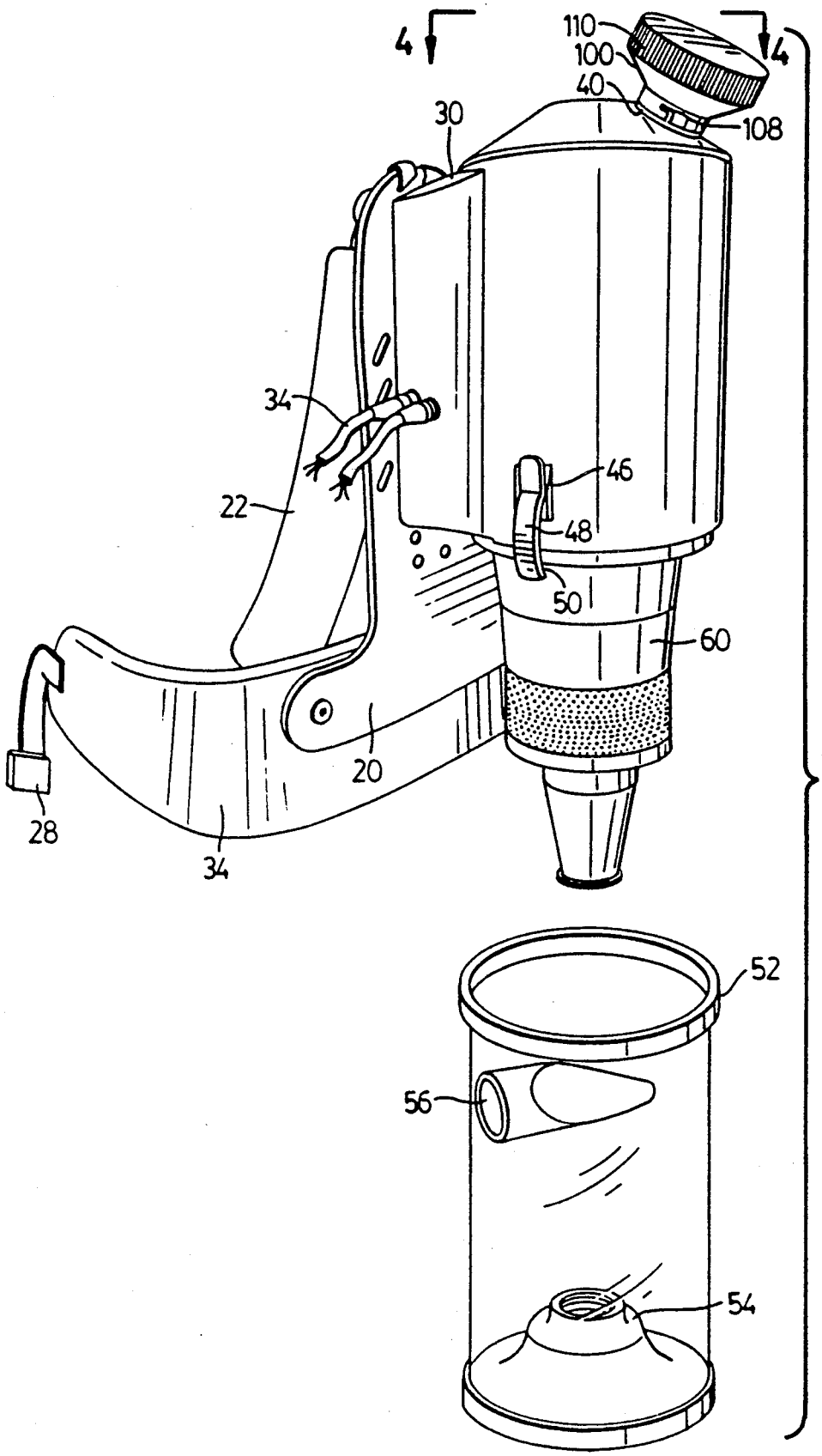
FIG. 3 is a perspective view from the rear of the vacuum cleaner of FIG. 1 with the lower casing removed.
Figure 4:
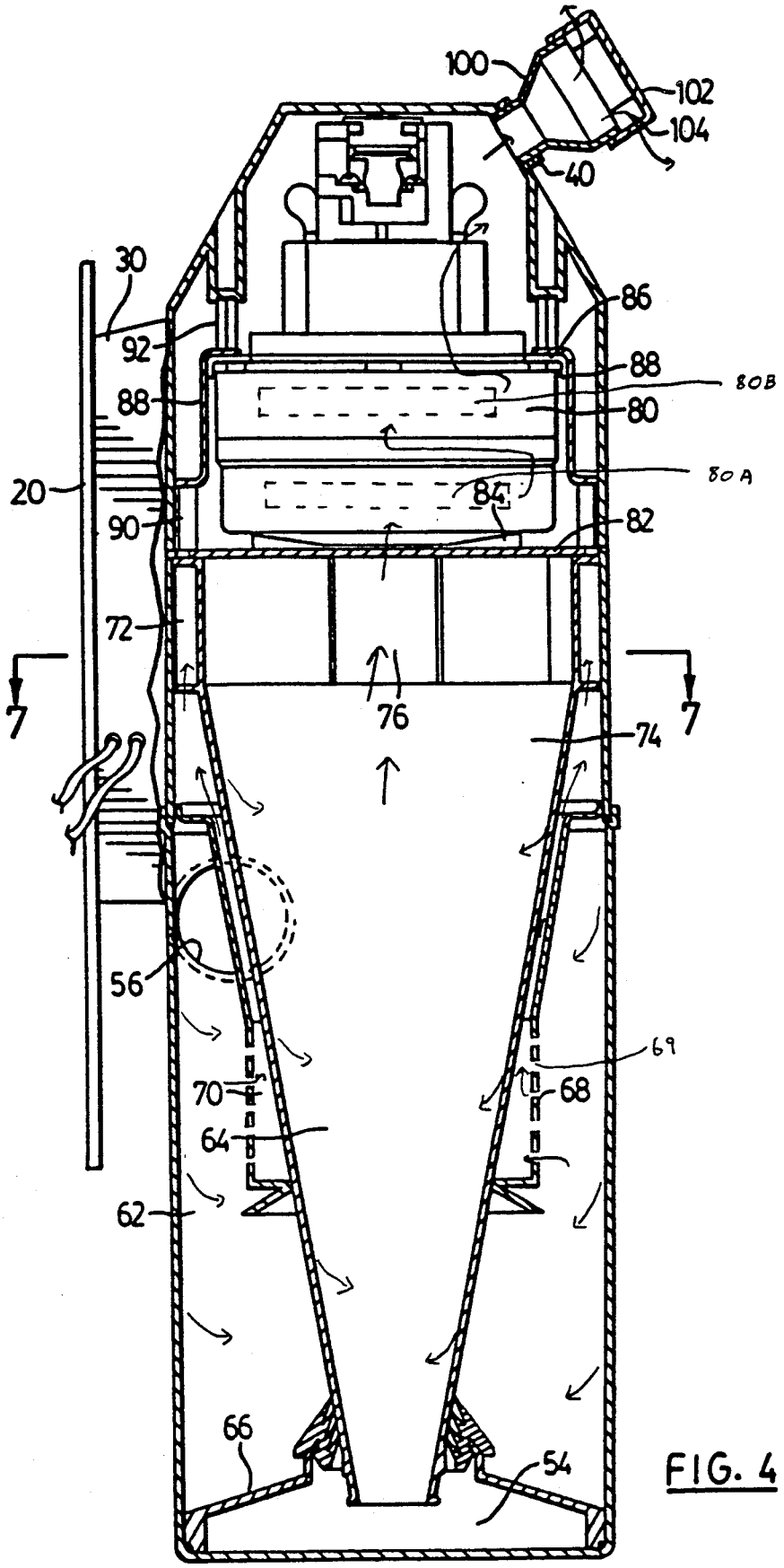
FIG. 4 is a cross-section along line 4—4 of the vacuum cleaner of FIG. 3.
Figure 5:
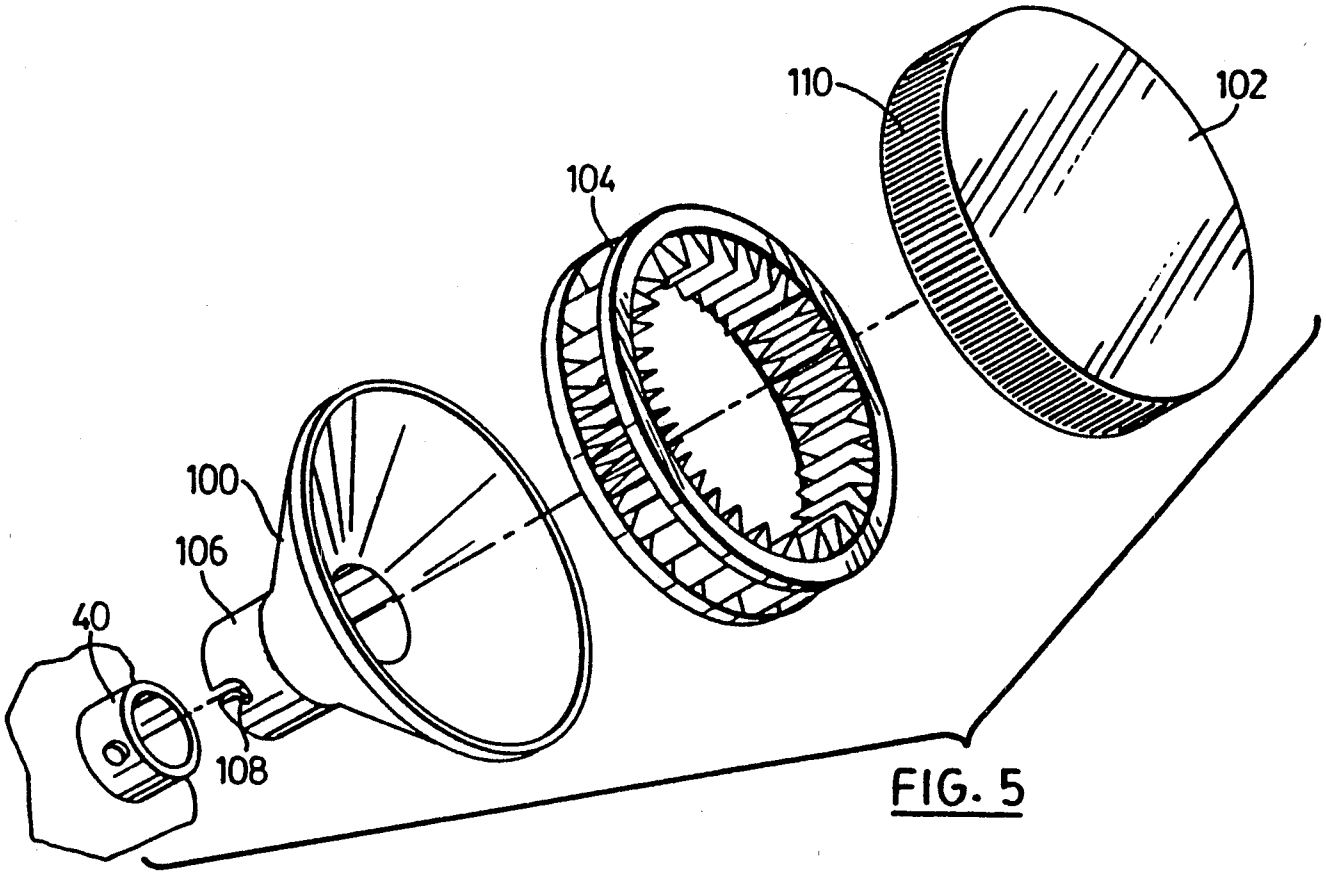
FIG. 5 is an exploded view of the after filter shown in FIGS. 1–4.
Figure 6:
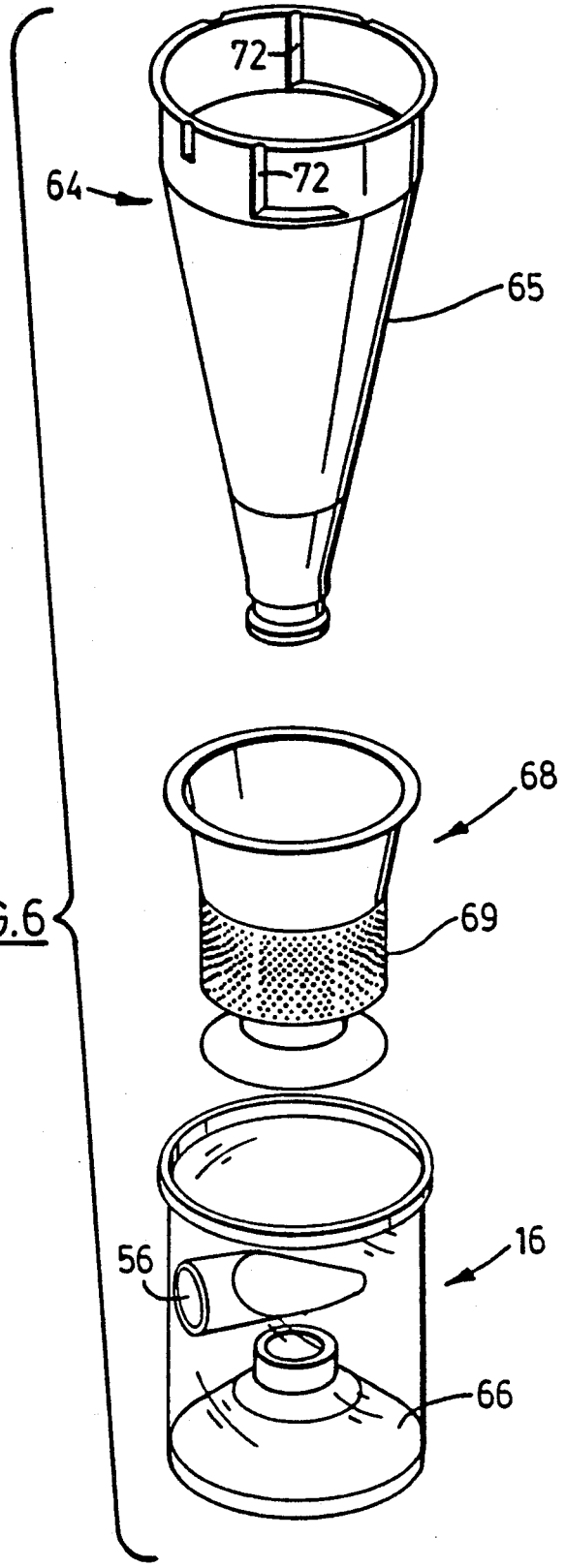
FIG. 6 is an exploded view of part of the cyclonic filter means of the vacuum cleaner of FIG. 1; and, FIG. 7 is a cross-section on the line 7—7 in FIG. 4.
Figure 7:
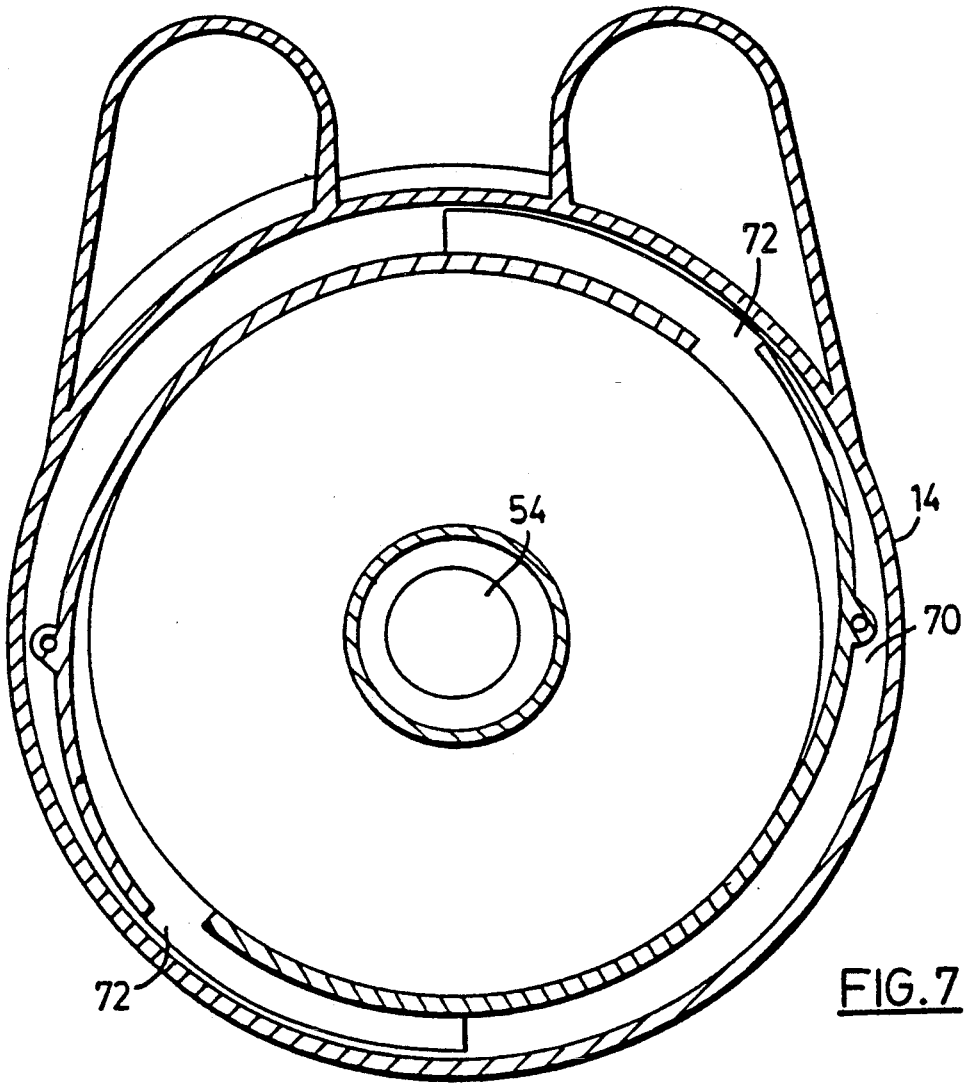

The use of dual cyclones in a vacuum cleaner results in a high level of particulate removal from the entrained air, including relatively small particles. However, when used in a toxic environment or in a clean room, the particulate emissions from vacuum cleaners must be exceptionally low, for example in the order of 99.99% of 0.3 micron particles. To meet this requirement, an after-filter may be installed on vacuum cleaner 10. This may be accomplished by adapting air exit port 40 to receive a filter. Preferably, the filter is positioned external to the upper casing. As shown in FIGS. 3 and 4, the after filter comprises a conical bottom portion 100, a top portion 102 and a filter 104. Bottom portion 100 has a base 106 which is securely attached to air exit port 40. Due to the pressure which builds up in the filter, the filter must be securely fixed to port 40. A suitable means of releasably securing the filter to air exit port 40 is by use of a boyonet mount 108. The exact size and shape of filter 104 will vary depending upon the particular emission standards which are set for use in various instances. However, by the use of an after-filter, it is possible to remove over 99.99% of 0.3 micron size particles form the dirt laden intake air. As shown in the Figures, filter 104 is in the shape of an annulus. Top portion 102 has a plurality of circumferentially spaced vents 110. In operation, the air enters through base 106 and passes into the centre of filter 104. The air passes through filter 104 and exits through vents 110.

By this modification, an after-filter may easily be added when required. The after-filter is a high efficiency and, preferably, high air flow filter. An example of a suitable filter material is HEPA or ULPA brand filter media. This material is an expensive synthetic material. By positioning the filter after the dual cyclones, the exhaust air has been substantially cleaned by the time it reaches the filter. This greatly increases the filter life. Further, the filter will act to an extent as a muffler to decrease the noise from the motor.

Lower casing 16 is releasably mounted on upper casing 14 by any means known in the art which provides a hermetic seal. In the preferred embodiment, latches 46 are provided adjacent the lower portion of upper casing 14. One latch may be positioned on either side of upper casing 14. Each latch 46 has an arm 48 which is pivotably mounted to the upper casing 14. The distal end of each arm 48 has a hook 50. This hook is designed to engage with rim 52 of lower housing 16. When lower casing 16 is mounted on upper casing 14, latches 46, in conjunction with rim 52, result in an air tight seal which avoids any pressure drop in the cyclone chambers.

Lower casing 16 has a receiving chamber 54 positioned adjacent its lower portion 66. Further, air entry port 56 is positioned adjacent the upper portion of lower casing 16. Air entry port 56 is configured to supply dirt laden air tangentially to the interior surface of lower casing 16. Air entry port 56 is configured to receive hose assembly 18.

Since air entry port 56 is positioned on lower casing 16, the air entry port may be positioned either on the left hand side or the right hand side of the unit simply by rotating lower casing 16 relative to upper casing 14 prior to engaging latches 46. By this adjustment, the vacuum cleaner may be used either by a right handed operator or a left handed operator.

The vacuum cleaner has a cyclonic cleaning assembly. Cyclone assembly 60 is mounted on upper casing 16 such that at least the lower part of the assembly is positioned within the lower casing 16. Preferably, as shown in FIG. 3 substantially all of cyclone assembly 60 is positioned within lower casing 16. Cyclone assembly 60 may be of any cyclone design which is known in the art of vacuum cleaners and comprises at least one cyclone. Preferably, the cyclone assembly comprises a first cyclone chamber and a second cyclone chamber in series and, for compactness, it is preferred to have the two cyclones mounted coaxially as shown in FIG. 4. Referring to FIG. 4, the first cyclone chamber is denoted by reference numeral 62 and the second cyclone chamber is denoted by reference numeral 64 and has an outer wall 65. The air enters the vacuum cleaner via air entry port 56. A centrifugal force is applied to the dirt laden air causing the dirt laden air to rotate within first cyclone chamber 62. The larger and heavier dirt is deposited in the lower portion of lower casing 16 (denoted by reference numeral 66). The air exits from the first cyclone chamber via first cyclone air exit 68 to passage 70. As shown in FIG. 3, first cyclone air exit 68 has a plurality of perforations 69 through which the partially cleaned air passes. Passage 70 is an annular passage defined by first cyclone air exit 68 and outer wall 65. The air travels through passage 70 to second air entry port 72. Second air entry port 72 imparts a tangential flow to the air causing the air to circulate in a cyclonic pattern within second cyclone chamber 74. The finer dirt particles are deposited in receiving chamber 54 and the cleaned air is evacuated from the second cyclone chamber through second cyclone air exit 76.

Motor 80 having a fan means comprising an impeller or the like for generating an air flow is positioned within upper casing 14 above the cyclone chambers. Motor 80 may be mounted to upper casing 14 by any means known in the art which dampens vibrations from the motor. As shown in FIG. 4, a plate 82, which is part of the upper casing, is positioned on top of the cyclone chambers. The plate seals the cyclone chambers to prevent any pressure drop. Second cyclone air exit 76 is positioned at the centre of plate 82. Rubber gasket 84 is positioned above plate 82. Motor 80 is then positioned on top of rubber gasket 84. The gasket prevents air leakage between the motor and cyclone air exit 76 and provides shock absorbing so as to dampen vibration from the motor. Cap 86 is placed on top of the motor and the entire assembly is secured into place by means of z-shaped clamp 88. Clamp 88 is secured to upper casing 14 by means of lower screw posts 90 and upper screw posts 92.

As shown in FIG. 4, motor 80 has two impellers generally designated by reference numerals 80A and 80B. The impellers are driven by motor 80 and generate an air flow. The air exits the second cyclone at second cyclone air exit 76 and enters the motor. The air passes by first impeller 80A and is then directed to second impeller 80B prior to exiting the motor and, from there, the vacuum cleaner through air exit port 40.

In operation, motor 80 drives a fan which generates an air flow which causes air to pass from a cleaning head or hose which is attached to air entry port 56 through air entry port 56, through the first cyclone chamber 62, via perforations 69 through first cyclone air exit 68, through passage 70 to second air entry port 72, through second cyclone chamber 74, out second cyclone air exit 76, past motor 80 and out port 40 as generally represented by the arrows in FIG. 4.

This configuration provides several advantages. First, by locating the motor at the top of the vacuum cleaner, the ergonomics are substantially improved. It has surprisingly been found that the use of this configuration provides a vacuum cleaner which feels very light weight and comfortable to the operator. This is achieved in part by mounting the motor at the top contrary to what has been utilized in previous designs. With the bulk of the mass of the vacuum cleaner (the motor) at the top, the unit is more securely held to the operator's back and tends to swing less and have less free motion than if the motor were at the bottom. This design results in the motor being substantially closer to the operator's ears than those utilized in previous designs. Despite this closeness, it has also surprisingly been found that the design is relatively quiet and may be used for extended periods of time without the need to apply expensive sound absorbing insulation to the upper casing. The sound level can be further reduced, as mentioned, by using a filter at air exit 40. Further, by positioning motor 80 directly above second cyclone air exit 76, the clean air may be used to cool the motor.

We claim:

1. A cyclonic vacuum cleaner comprising:

(a) a back pack harness;

(b) an upper casing attached to said harness;

(c) a lov er casing releasably mounted on said upper casing;

(d) at least one cyclone having a lower part and an air exit port, said cyclone being mounted with at least said lower part positioned within said lower casing;

(e) an air entry means providing an air flow path from outside said vacuum cleaner to said at least one cyclone;

(f) air exit means providing an air flow path from said at least one cyclone to outside said vacuum cleaner; and, (g) fan means driven by a motor positioned within said upper casing above said at least one cyclone for generating an air flow which passes through said air entry means, through said at least one cyclone and through said air exit means.

2. A cyclonic vacuum cleaner as claimed in claim 1 wherein said air entry means comprises an entry port for supplying dirt laden air tangentially to said at least one cyclone to produce cyclonic rotation of said air within said at least one cyclone, said port being located near the top of said at least one cyclone and adapted to receive a hose assembly.

3. A cyclonic vacuum cleaner as claimed in claim 2 wherein the top of said lower casing is located near the top of said at least one cyclone and said port is provided in said lower casing.

4. A cyclonic vacuum cleaner as claimed in claim 3 wherein said lower casing is substantially circular in cross section and comprises the outer wall of the first of said at least one cyclone such that the lower casing may be mounted onto said upper casing with said port positioned to the right or the left of said harness for use by a right or a left handed user.

5. A cyclonic vacuum cleaner as claimed in claim 1, wherein said motor is positioned in the air flow path from said at least one cyclone to outside said vacuum cleaner.

6. A cyclonic vacuum cleaner as claimed in claim 5, wherein said motor is positioned above the air exit port from said at least one cyclone, and said air exit means comprises an exit port on the upper portion of said upper casing.

7. A cyclonic vacuum cleaner as claimed in claim 6, wherein the air from the air exit port from said at least one cyclone cools said motor prior to passing through said exit port.

8. A cyclonic vacuum cleaner as claimed in claim 7, wherein said exit port of said upper casing is positioned and configured to direct air flow away from the operator.

9. A cyclonic vacuum cleaner as claimed in claim 6, wherein said exit port of said upper casing is adapted to receive a hose so that said vacuum cleaner may also be used as a blower.

10. A cyclonic vacuum cleaner as claimed in claim 6, wherein said exit port of said upper casing is adapted to receive a filter.

11. A cyclonic vacuum cleaner as claimed in claim 6, and including a filter positioned external to said upper casing over said exit port of said upper casing.

12. A cyclonic vacuum cleaner as claimed in claim 1 wherein said at least one cyclone comprises a first cyclone and a second cyclone in series.

13. A cyclonic vacuum cleaner as claimed in claim 12 wherein said first cyclone and said second cyclone are mounted coaxially in said vacuum cleaner.

14. A cyclonic vacuum cleaner as claimed in claim 13, wherein said air exit port is the exit from said second cyclone and said motor is positioned in the air flow path from the exit of said second cyclone to outside said vacuum cleaner.

15. A cyclonic vacuum cleaner as claimed in claim 1 wherein said back pack harness comprises a back plate having a lower portion, two shoulder straps each of which has first and second ends and a waist strap attached to said lower portion of said back plate, said first end of each of said shoulder straps being attached to said back plate and said second end of each of said shoulder straps each being attached to said waist strap.

16. A cyclonic vacuum cleaner comprises:

(a) a back pack harness;

(b) an upper casing attached to said harness;

(c) a lower casing releasably mounted on said upper casing;

(d) first and second coaxially positioned cyclones having a lower part, said second cyclone being mounted within said first cyclone, said second cyclone having a cyclone exit port, said cyclones being mounted with at least said lower part positioned within said lower casing, said coaxial cyclones mounted so that dirt laden air will enter the first outer cyclone and then the second inner cyclone before exiting through said cyclone exit port;

(e) an air entry port positioned on said lower casing for supplying dirt laden air tangentially to said outer cyclone to produce cyclonic rotation of said air within said outer cyclone, said port being located near the top of said outer cyclone and adapted to receive a hose assembly;

(f) an air exit port provided on said upper casing; and, (g) fan means driven by a motor positioned within said upper casing above said cyclones for generating an air flow which passes through said air entry port, said outer cyclone, said inner cyclone, said cyclone exit port, past said motor and out said air exit port.

17. A cyclonic vacuum cleaner as claimed in claim 16 wherein said lower casing is substantially circular in cross section and comprises the outer wall of said first cyclone such that the lower casing may be mounted onto said upper casing with said port positioned to the right or the left of said harness for use by a right or a left handed user.

18. A cyclonic vacuum cleaner as claimed in claim 17 wherein said motor is positioned between the cyclone exit port and said air exit port so that the air from the exit from the second cyclone cools said motor before passing through said air exit port.

19. A cyclonic vacuum cleaner as claimed in claim 18, and including a filter positioned external to said upper casing over said exit port of said casing.

20. A cyclonic vacuum cleaner as claimed in claim 18 wherein said back pack harness comprises a back plate having a lower portion, two shoulder straps each of which has first and second ends and a waist strap attached to said lower portion of said back plate, said first end of each of said shoulder straps being attached to said back plate and said second end of each of said shoulder straps each being attached to said waist strap.

* * * * *